US006672858B1

(12) United States Patent
Benson et al.

(10) Patent No.: US 6,672,858 B1
(45) Date of Patent: Jan. 6, 2004

(54) METHOD AND APPARATUS FOR HEATING A FURNACE

(76) Inventors: Charles E. Benson, 18 Bear Hill Rd., Windham, NH (US) 03087; Roberto O. Pellizzari, 95 Raddin Rd., Graton, MA (US) 01450; Peter J. Loftus, 29 Roberts Rd., Cambridge, MA (US) 02138; Dennis L. Juedes, 8100 Crooked Oaks Ct., Gainsville, VA (US) 20155; Richard R. Martin, 3807 S. Victor, Tulsa, OK (US) 74105; Earl Ray Wade, 2315 S. Indianwood Ave., Broken Arrow, OK (US) 74012; Paul M. Rodden, P.O. Box 702761 (Hwy. 16), Beggs, OK (US) 74421

( * ) Notice: Subject to any disclaimer, the term of this patent is extended or adjusted under 35 U.S.C. 154(b) by 133 days.

(21) Appl. No.: 09/907,793

(22) Filed: Jul. 18, 2001

(51) Int. Cl.[7] ..... F23M 3/00
(52) U.S. Cl. ..... 431/9; 431/116
(58) Field of Search ..... 431/116, 36, 41, 431/161, 162; 126/110; 43/115, 9

(56) References Cited

U.S. PATENT DOCUMENTS

| | | | | |
|---|---|---|---|---|
| 4,551,089 A | * | 11/1985 | Miyahara | 431/116 |
| 5,073,105 A | | 12/1991 | Martin et al. | |
| 5,984,665 A | | 11/1999 | Loftus et al. | |
| 6,007,325 A | | 12/1999 | Loftus et al. | |
| 6,027,330 A | * | 2/2000 | Lifshits | 431/8 |

* cited by examiner

*Primary Examiner*—Henry Bennett
*Assistant Examiner*—Sabrina Dagostino
(74) *Attorney, Agent, or Firm*—McDonnell Boehnen Hulbert & Berghoff

(57) ABSTRACT

An improved process for heating furnaces using a burner design that produces very low level of undesirable nitrogen oxides is provided. The process recirculates a large volume of furnaces gases back to the burner where it is mixed with fuel gas in a plurality of recirculation ports prior to combusting with air in a primary combustion zone. Dispersion of the fuel gas in the recirculated furnace gases is believed to result in lower peak flame temperatures and therefore minimizing the formation of the pollutants, such as nitrogen oxides.

3 Claims, 4 Drawing Sheets

METHOD AND APPARATUS FOR HEATING A FURNACE

BACKGROUND OF THE INVENTION

1. Field of the Invention

Our invention relates to an environmentally friendly method of heating a furnace using improved gas-fired burners, particularly the type found in industrial furnaces. More specifically, our improved heating process uses a burner design that produces extremely low levels of $NO_x$.

2. The Prior Art

Industrial gas burners are designed to generate heat and produce high temperatures, typically in the range of from 1,200° F. to 2,300° F. At such temperatures, thermal nitrogen oxides ($NO_x$) can form as gaseous byproducts of the combustion of air and the hydrocarbon gas used as the fuel in the burners. These $NO_x$ byproducts are a major source of air pollution and governmental authorities have instituted strict environmental regulations limiting the amount of $NO_x$ gases that can be emitted into the atmosphere. The art has recognized that reducing the peak flame temperature of industrial burners can minimize $NO_x$ formation. As taught in U.S. Pat. No. 5,073,105, lower flame temperatures may be achieved by recirculating a small portion of exhaust gases (also known as furnace or flue gases) into the combustion zone to mix with the hydrocarbon fuel and combustion air. Specifically, the recirculated furnace gases are mixed with hydrocarbon fuel gas followed by mixing with the combustion air before combustion. U.S. Pat. Nos. 6,007,325 and 5,984,665 describe a burner design that has three flame regions, where the first region is formed using a pre-mix burner tip to combust a lean fuel-air mixture. In addition to the pre-mix burner tip, these designs also use recirculated furnace gases. Although prior burner designs may have recirculated a small or limited amount of furnace gases, the art has not fully recognized the importance that recirculated furnace gases have on reducing $NO_x$ formation. In particular, there is very little, if any, teaching suggesting that dramatically increased amounts of recirculated furnace gases will greatly reduce $NO_x$ levels without adversely affecting burner performance. Indeed, prior to our invention it was believed that increasing the amount of recirculated furnace gases would, at minimum, cause flame instability. Contrary to that accepted view, we have found that significantly increasing the amount of furnace gases circulated back to the burner did not affect flame stability. Instead, the increased flow of furnace gases greatly lowered the amount of $NO_x$ gases formed to levels of less than 10 ppm. These low levels were obtained without the use of a complicated pre-mix burner apparatus.

Accordingly, an object of our invention is to provide a method for heating an industrial furnace with an improved burner design that has greatly reduced $NO_x$ emissions.

Another object of our invention is to provide an improved burner design that recirculates significantly more furnace gases than prior designs in order to prevent excessive flame temperatures and thus greatly reduce the formation of nitrogen oxides.

Yet another object of our invention is to provide a process of heating a furnace where furnace gas is recirculated back to the burner through recirculation ports having at least 5 sq. in. of total cross-sectional port exit area per 1 million (MM) BTU/hr of heat generated.

SUMMARY OF THE INVENTION

As stated, our invention is directed to a process for heating industrial furnaces using an improved gas fired burner design. Our process and improved burner design generates less than 10 ppm by volume of $NO_x$. Such low levels of nitrogen oxides will greatly reduce the air pollutants currently being emitted by existing industrial furnaces using prior art burners. Our improved burner design produces a cooler flame and thus lowers $NO_x$ formation. These benefits are possible because of modifications that we have made to the tile design, recirculation port configuration, and gas tip configuration and placement. By use of the term "recirculation port" we mean any opening or channel through the burner block that is designed to channel a mixture of fuel gas and furnace gases into the primary combustion zone. Each burner of our invention can be characterized by a "total recirculation port area," which we define as the sum of the individual cross-sectional areas of each recirculation port exit opening. The "exit opening" is the port opening that is adjacent and in communication with the primary combustion zone. The "entrance opening" is the port opening adjacent to the primary fuel tip and where the recirculation furnace gases enter the recirculation port. The cross-sectional area of the port exit opening is measured at the outermost edge of the exit opening.

One of the most significant improvements in our new burner design is the ability to recirculate a large amount of furnace gases back to the burner for mixing with the fuel gas prior to combustion, when compared to prior art designs. In some cases we are able to recirculate a significantly greater amount of furnace gases as compared to prior art designs. Surprisingly and unexpectedly we have found that recirculating such a large amount of the furnace gases dramatically reduces the amount of $NO_x$ gases formed without causing flame instability. Increasing the amount of furnace gases returned to the burner improves the mixing and dispersion of the fuel gas prior to combusting the fuel with air. By using the relatively inert furnace gases to disperse the fuel gas prior to mixing with the combustion air in the primary combustion zone, a cooler burning flame is achieved. A cooler flame in turn greatly reduces the undesirable formation of $NO_x$. In addition to lowering the $NO_x$ formed, we also found that increased recirculation of furnace gas did not adversely affect flame stability. Moreover, our improved burner design allowed us to eliminate the need for a lean pre-mix burner tip of the kind described and used in the prior art.

The increase in furnace gas recirculation is achieved in part by increasing the available cross-sectional area of the recirculation ports. The recirculation ports resemble large holes or tunnels, which are located around the circumference of the burner tile (also known as the burner block) and which allow the furnace gases to pass from the outside of the burner into the primary combustion zone located in the center of the burner. Typical prior art designs have no more than 4.8 $in^2$ of total recirculation port area per million (MM) BTU/hr, whereas our design has increased the total recirculation port area to at least 5 $in^2$ per MM BTU per hr. Our preferred range is from at least 5 $in^2$ per MM BTU per hr to about 12.5 $in^2$ per MM BTU per hr. Accordingly, for a 1 MM BTU burner design the total recirculation port area would be 5 $in^2$. Likewise, for an 8 MM BTU burner, the recirculation port area would be 40 $in^2$. This increase in recirculation port area can be achieved in a number of ways, including increasing the total number of ports or increasing the physical size of the existing number of ports, compared to designs currently in use. Our preferred design increases the number of ports by 1.5 to 2.0 times the number used in prior devices and/or modifies the shape of the port. In our most preferred design, each recirculation port exit opening is at least 0.625

$in^2$ per MM BTU/hr of heat generated by the burner. As those skilled in the art will appreciate, calculating the heat duty (or heat generation) of a burner is accomplished using well known engineering principles and is a function of fuel type, fuel tip area and fuel pressure. More typically, one can determine the heat generation of a given burner by consulting the manufacturer's specification, which is usually equivalent to the specification set by the customer. The heat generation referred to in this application is the total heat generation and is based on both the primary and secondary fuel tips. In our preferred design, 15 to 45% of the total heat generation is due to the primary fuel tips. Accordingly, using the primary fuel heat generation as a basis, our invention would have a range of total available cross-sectional area of from about 5 $in^2$ per 150,000 BTU per hr to about 5 $in^2$ per 450,000 BTU per hr.

As mentioned, we have also found that it is highly advantageous to change the shape of the recirculation ports by having the opening or entrance of the port on the outside surface of the burner tile larger than the exit opening on the inside surface of the burner tile. Also, instead of having the port entrance with sharp corners, we have rounded at least part of the entrance opening. This tapered port and contoured inlet configuration of the port entrance enhances a venturi effect that in turn increases the quantity of furnace gases drawn into the recirculation ports. Moreover, by increasing the venturi effect there is an improvement in the mixing of the fuel gas and recirculated furnace gas. In a preferred design the edges of the port entrance openings are rounded or curved in shape and have a radius of at least ½ inch. To further enhance the venturi effect we position the primary fuel gas tip outside of the recirculation port entrance. This configuration further assists in drawing the furnace gases and fuel gas into the port where they are intimately mixed and dispersed prior to exiting into the primary combustion zone of the burner. This well mixed fuel/furnace gas mixture is then mixed with air and is combusted in the primary combustion zone. By dispersing the fuel gas in the inert furnace gases in the recirculation port prior to mixing with the combustion air greatly reduces the chance that high peak flame temperatures will occur and thus reduces the possibility that high levels of $NO_x$ will form.

Another improvement found in a preferred embodiment of our burner design is an increased tile wall thickness. Typical prior art designs have tile thickness of 3 inches or less. The thicker tile wall increases the length of the recirculation port wall, thus effectively increasing the residence time available for the fuel and furnace gases to mix. The thickness of the tile wall is measured along the centerline of the recirculation ports. A preferred thickness is greater than 3 inches, more preferably 5 ½ inches or more. Another way to increase the residence time is to increase the distance from the primary fuel tip orifice to the exit opening of the recirculation port. In prior art burners this distance is a maximum of about 4 inches. We have found that distances greater than 4 inches will be beneficial. The increased residence time allows the fuel gas to more completely disperse in the recirculated furnace gases prior to exiting the recirculation port and entering the primary combustion zone. In addition, the increased length of the ports reduces the tendency of air migrating into the port prior to combustion with the fuel/furnace gas mixture in the primary combustion zone. The primary fuel tips used to inject fuel into the recirculation ports is located on a fuel pipe connected to a fuel gas manifold. In some cases it is advantageous to combine the primary and secondary fuel tips on a single fuel pipe. This is referred to as doubled drilled tips or a combination of secondary and primary tips, where the primary fuel tip is drilled into the lower portion of the pipe and the secondary fuel tip is drilled into the upper portion of the fuel pipe. Another design uses separate fuel pipes for the primary and secondary fuel tips.

BEST MODE FOR CARRYING OUT THE INVENTION

Figure 1:
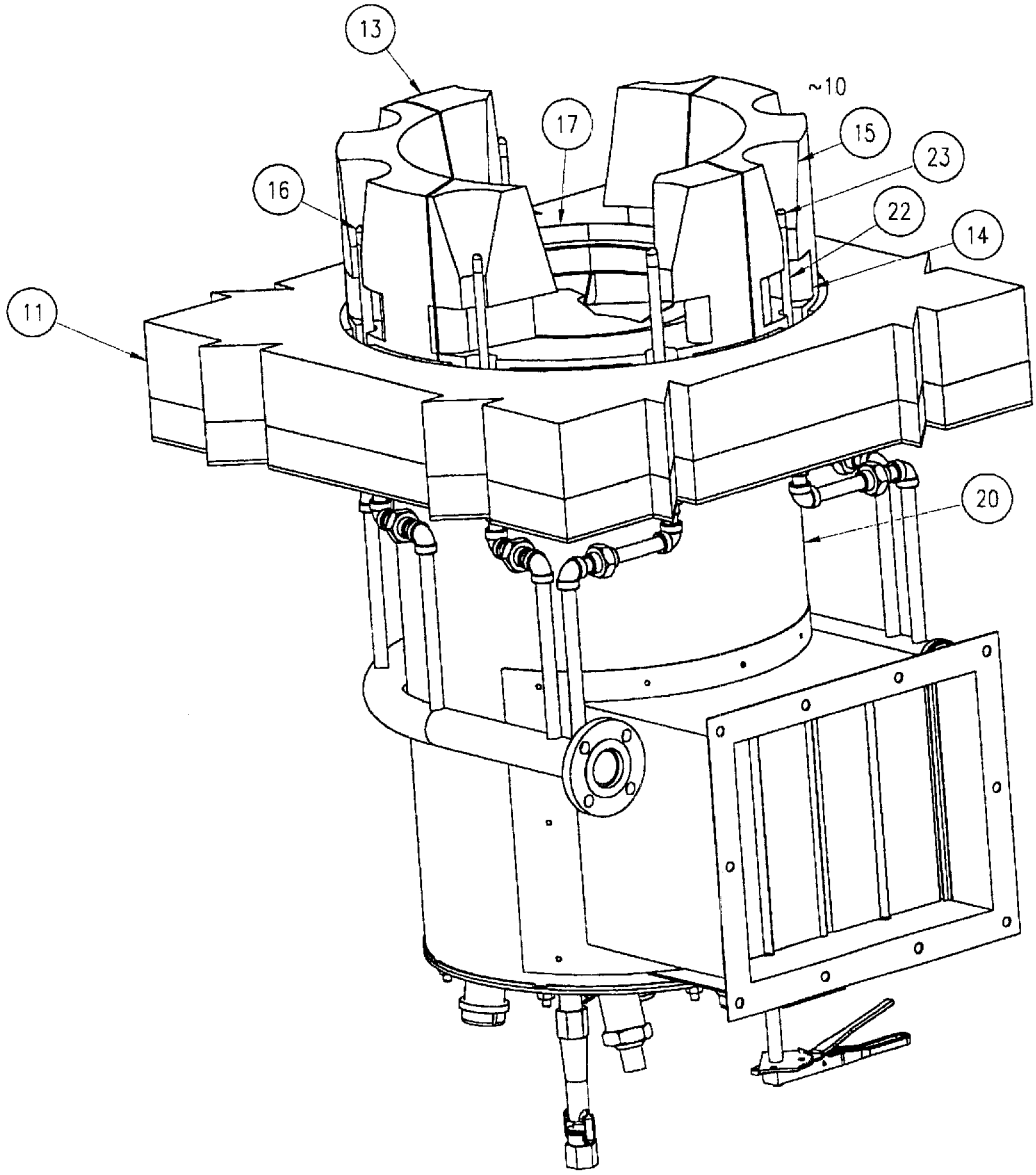
FIG. 1 is a perspective view of the entire burner assembly of our invention.

While our invention is susceptible of embodiment in many different forms, there is shown in the drawings and will be described below in detail, a specific embodiment with the understanding that the present disclosure is to be considered an exemplification of the principles of the invention and is not intended to limit our invention to the embodiment illustrated.

While the embodiments of the invention discussed below are shown in the environment of a floor of a furnace, it should be understood that the burners of the present invention may also be installed in a side wall or roof of a furnace, which suitable modification which would be readily apparent to one of ordinary skill in the art having the present disclosure before them, without departing from the principles of the invention. In addition, although the furnaces of the present invention are discussed with respect to natural ("thermal") draft furnaces, it is to be understood that powered burners and/or induced draft burners are also intended to be encompassed by the principles of the invention described herein, with suitable modifications which would be readily apparent to one of ordinary skill in the art having the present disclosure before them.

Figure 2:
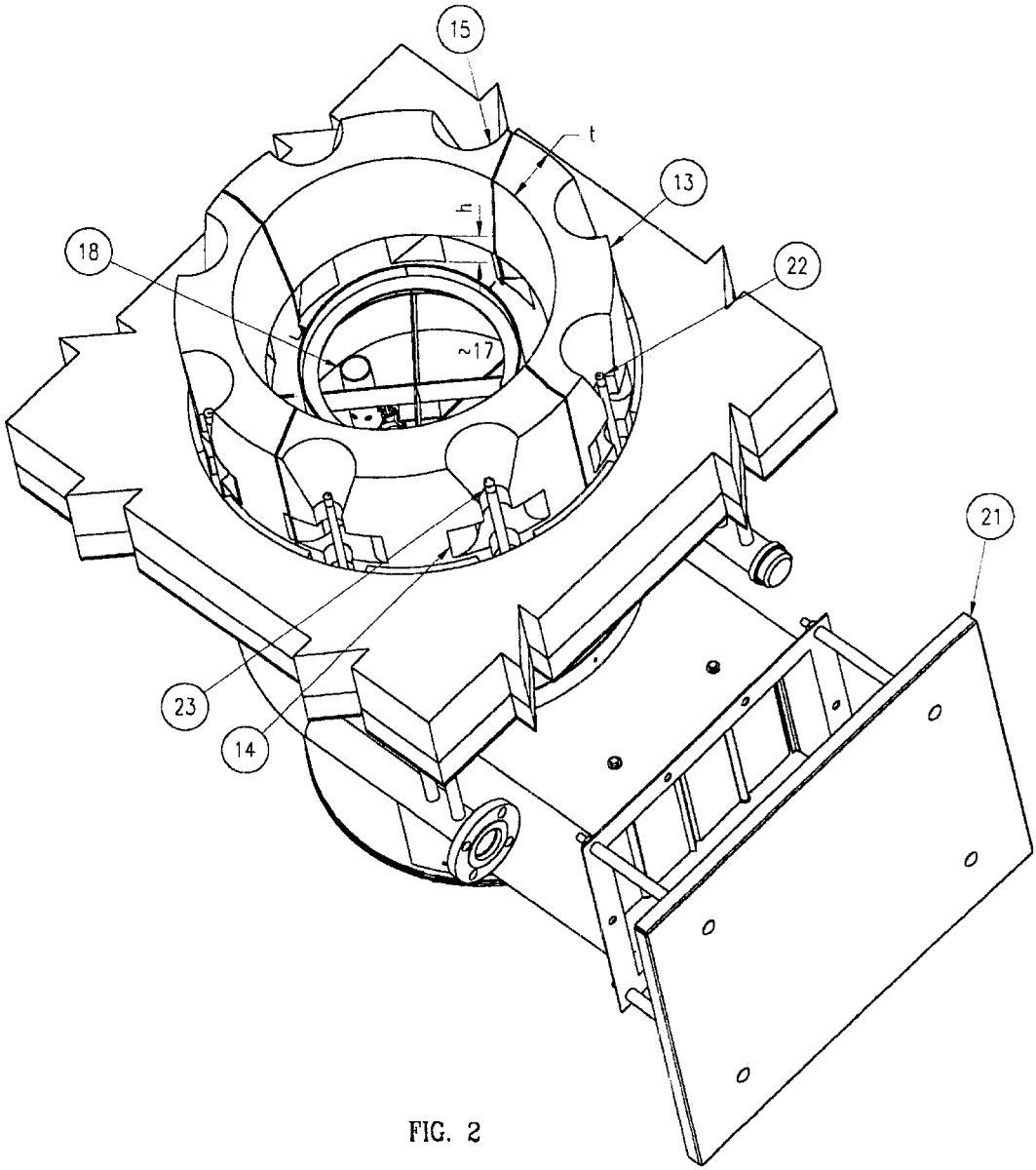
FIG. 2 is a close-up perspective view of the burner tile of our invention.

FIGS. 1 and 2 illustrate schematically a low NOx burner according to a preferred embodiment of our invention. For clarity purposes, part of burner block 13 is not shown in FIG. 1 in order to show details of the internal portions of the burner. FIG. 2, however, illustrates the complete burner block configuration. Burner assembly 10 is mounted or otherwise fixed to furnace wall, roof or floor 11 through title plate 12. Burner assembly 10 includes burner block 13 (also referred to as "burner tile") which extends outwardly into the furnace heating zone and has a certain thickness, designated in the figures as dimension t and is measured along the centerline of recirculation ports 14. Burner block 13 also has a plurality of recirculation ports 14 and depressions 15 located around the top outside portion of burner block 13. Double drilled fuel pipes 16 with primary fuel tips 22 and secondary fuel tips 23 are connected to fuel gas manifold 19 and positioned adjacent to the exterior of burner block 13 such that the primary fuel tips are directed into recirculation ports 14. Secondary fuel tips 23 are directed upward and into indentations 15. These indentations or depressions in the burner block can be scalloped in shape or any other shape so long as the fuel gas is not directed perpendicular to the surface of the top surface of the burner block. Combustion of the fuel gas delivered by secondary fuel tips 23 creates a secondary combustion zone above primary combustion zone 24. Flame holder 17 defines the bottom of primary combustion zone 24. Pilot tip 18 is for lighting off the burner during start-up.

Below the burner block 13 and furnace floor/wall 11 is wind box 20, which receives combustion air through air opening 24. Damper 21 regulates the amount of combustion air flowing into wind box 20 and up through flame holder 17, and ultimately into combustion zone 24. Blowers or other known means can be used to increase the amount of combustion air, if needed. Fuel gas manifold 19 is attached to the outside of wind box 20 and feeds fuel gas to each of the double-drilled fuel pipes 16.

Figure 4:
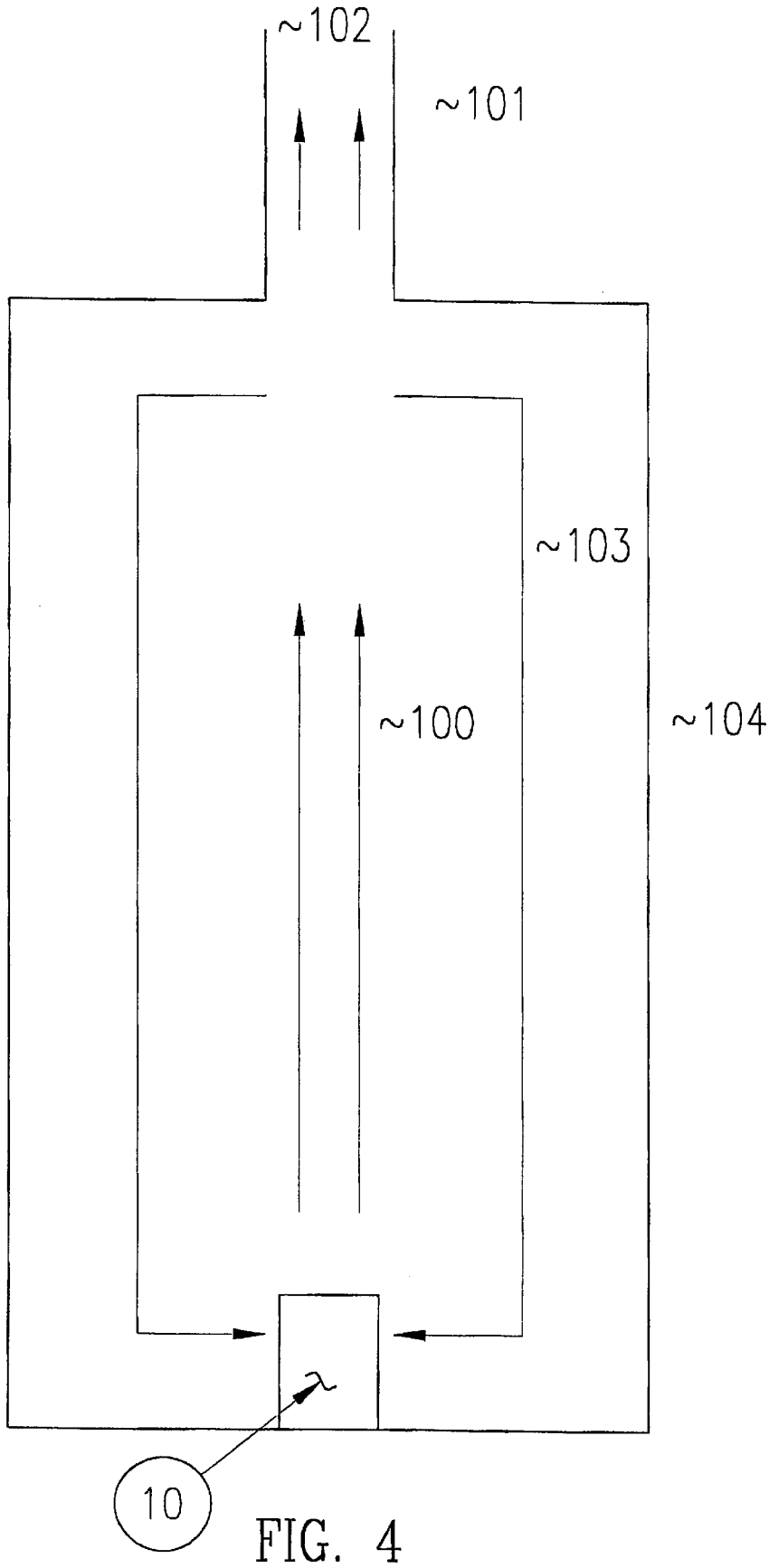
FIG. 4 is a schematic illustration showing the flow of furnace gases within the furnace.

In operation, fuel gas is injected through primary gas tips 22 into the openings of recirculation ports 14. The fuel gas is mixed with furnace gases that comprise a portion of the combustion products that are recirculated back to the burner. FIG. 4 schematically illustrates a furnace 104 and how a portion 103 of the furnace gases 100 is recirculated back to the burner assembly 10. The remaining furnace gases 102 are discharge through flue 101. We have found that when the amount of furnace gases recirculated through the burner recirculation ports is dramatically increased, the formation of NOx can be kept to an extremely low level of 10 ppm or less. The increased amount of recirculated furnace gases is achieved by increasing the total available cross-sectional area of the recirculation ports. We believe the increased amount of recirculated furnace gases greatly enhances the dispersion of the fuel gas before it mixes and combusts with the air in the primary combustion zone. Because the furnace gases are primarily composed of combustion products they are essentially inert and thus do not contribute to the potential for creating hot spots in the flame profile that can ultimately result in the formation of the undesirable nitrogen oxides. In fact, we believe the increased amount of furnace gases has the opposite effect, that of dissipating the temperature profile of the flame, resulting in a cooler flame. We further believe that this may be due to the inherent heat capacity of the furnace gases, which acts to actually absorb excess heat. A cooler flame will reduce the formation of nitrogen oxides.

Figure 3:
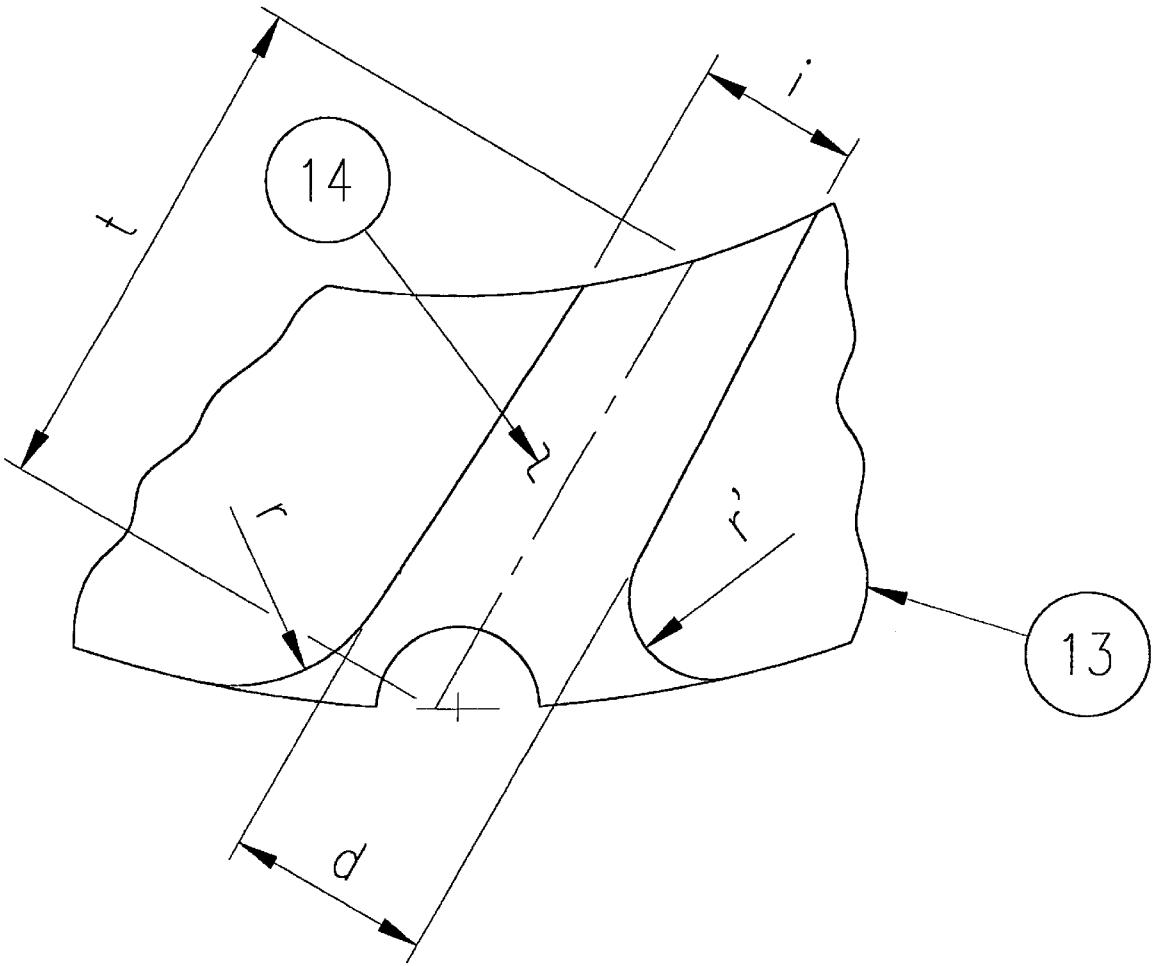
FIG. 3 is a cross-sectional view of the burner tile showing the shape and dimensions of the recirculation ports and tile thickness.

The recirculated furnace gases pass through recirculation ports 14 where they intimately mix and disperse the fuel injected from primary fuel tips 22. A preferred shape of recirculation ports 14 is illustrated in FIG. 3. A preferred configuration of ports 14 has entrance openings d that is greater in dimension than exit openings i, with constant port height in (FIG. 2), although other geometries can be utilized to reduce flow path area, such as by tapering the top and bottom surfaces. Likewise, while a rectangular shaped port is illustrated any shaped port can be utilized, including round, oval or square. The contoured edge of the entrance openings is shown with one side of the opening having a radius of 1 inch and the other side of 2 inches. Preferably, each recirculation port 14 is oriented relative to the center axis of burner block 13 so that the direction of flow of the mixture of fuel gas and furnace gases is offset from radial, preferably at angle of at least 30 degrees relative to flame holder 17. The thickness t of burner block 13, measured as the centerline of the recirculation ports, in our preferred design is approximately 1.8 times the thickness of prior art burner block. In a most preferred design, the burner block thickness is greater than 5.5 inches and preferably at least 6.25 inches. This increased thickness increases the residence time of the recirculated furnace gases and fuel gas within the recirculation ports 14 and allows for maximum dispersion of the fuel gas in the recirculated furnace gases. Because the presence of the primary fuel tip plays a role in causing the furnace gases to be recirculated through the recirculation ports, the distance from the primary fuel tip to the recirculation port exit opening should be at least 5.5 inches, more preferably in the range of from about 5.5 to 7.5 inches. The number and size of recirculation ports 14 partially determines the total amount of recirculated furnace gases recirculated and made available for mixing with the fuel gas prior to entering primary combustion zone 24. Our preferred design has at least 8 recirculation ports having a total recirculation port area of at least 5 $in^2$ per MM BTU/hr of heat generated as measured by exit dimension i and height h. (See FIG. 2). Alternatively, the recirculation ports 14 can be characterized by calculating the amount of heat generated by the burner divided by the total recirculation port area, again measured at the exit i of the port on the inside of burner block 13. Preferably, the number and size of the recirculation ports 14 is sufficient to allow the burner to generate heat in the range of from about 80,000 to about 200,000 BTU/hr/$in^2$ of total recirculation port area of the port exit openings. Although we have shown a preferred embodiment of our burner having a circular shaped title, our improved burner design could likewise be rectangular, oval or square in shape.

Use of the improved burner design of the present invention, and the attendant process for heating a furnace which are provided by it, thus results in numerous advantages, many of which are mentioned above. It will be understood that our invention may be embodied in other specific forms without departing from its spirit or central characteristics. The above-mentioned embodiments and figures, therefore, are to be considered in all respects as illustrative and not restrictive, and the invention is not to be limited to the details given here.

We claim:

1. A method of heating a furnace comprising, in combination, the steps of, a. providing at least one burner having a primary combustion zone in communication with a plurality of recirculation ports defining a predetermined total cross sectional area measured at the interface of the primary combustion zone and the recirculation port;

b. introducing fuel gas to the burner through a plurality of fuel tips to generate heat at a total rate of less than or equal to 200,000 BTU/hr/$in^2$ of total cross-sectional area of the recirculation ports;

c. combusting a portion of the fuel gas in the primary combustion zone to produce heat and furnace gases;

d. recirculating a portion of the furnace gases to the burner and dispersing the fuel gas within the recirculated furnace gases in the recirculation ports prior to combustion; and e. removing a portion of the furnace gases from the furnace.

2. The method of claim 1 where heat is generated at a rate of from about 80,000 to about 200,000 BTU/hr/$in^2$ of total cross-sectional area of the recirculation ports.

3. The method of claim 1 where there is no premixing of air and fuel gas prior to combustion of the fuel introduced from primary fuel tips.

* * * * *